United States Patent [19]

Sagel et al.

[11] 4,169,064

[45] Sep. 25, 1979

[54] DETERGENT COMPOSITIONS CONTAINING STARCH

[75] Inventors: John A. Sagel, Mt. Healthy; Edward J. Wandstrat, Cincinnati, both of Ohio

[73] Assignee: The Procter & Gamble Company, Cincinnati, Ohio

[21] Appl. No.: 864,133

[22] Filed: Dec. 23, 1977

[51] Int. Cl.[2] ..... C11D 3/22

[52] U.S. Cl. ..... 252/174.17; 252/8.9; 252/135; 252/140; 252/174.21

[58] Field of Search ..... 252/8.9, 89, 135, 140, 252/526, 527, 528, 531, 539, 540, 545, 546, 547, 550, 551, 558, 559

[56] References Cited

U.S. PATENT DOCUMENTS

| | | | |
|---|---|---|---|
| 2,489,955 | 11/1949 | Colgate et al. | 252/550 |
| 3,803,285 | 4/1974 | Jansen | 264/143 |
| 3,892,681 | 7/1975 | Edwards et al. | 252/551 |
| 3,932,295 | 1/1976 | Fujino et al. | 252/102 |
| 3,945,951 | 3/1976 | Arai et al. | 252/546 |
| 4,000,080 | 12/1976 | Bartolotia et al. | 252/99 |
| 4,077,890 | 3/1978 | Barker | 252/8.8 |
| 4,116,854 | 9/1978 | Temple et al. | 252/167 |

FOREIGN PATENT DOCUMENTS

| | | |
|---|---|---|
| 51-5306 | 1/1976 | Japan . |

*Primary Examiner*—P. E. Willis, Jr.

*Attorney, Agent, or Firm*—Robert B. Aylor; Richard C. Witte; Thomas H. O'Flaherty

[57] ABSTRACT

Laundry detergent compositions comprising an organic surface-active agent and low concentrations of substantially water-insoluble starch, the starch being added to the compositions as an intimate comixture with polyethylene glycol having a molecular weight of from about 400 to about 50,000, are disclosed. These compositions impart anti-wrinkling and ease-of-ironing benefits to fabrics laundered with them.

18 Claims, No Drawings

DETERGENT COMPOSITIONS CONTAINING STARCH

BACKGROUND OF THE INVENTION

This invention relates to laundry detergent compositions of the type disclosed in U.S. Pat. No. 3,892,681, Edwards and Diehl, issued July 1, 1975, said patent being incorporated herein by reference. The dry starches disclosed in that patent are, in general, quite dusty and difficult to handle, posing a potential dust explosion hazard, in the processing of the detergent compositions. The detergent compositions described in U.S. Pat. No. 4,116,854, Temple et al, issued Sept. 26, 1978, also incorporated herein by reference, utilizes water-insoluble starch which contains from about 0.01% to about 5% by weight of a substantially water-insoluble organic liquid as a means of minimizing these dust/handling problems, while simultaneously providing the fabric care benefits described in the Edwards et al patent. These compositions, however, may leave laundered fabrics with difficult to remove creases, if those fabrics are not removed from the laundry dryer promptly at the conclusion of the heated drying cycle.

By utilizing the compositions described herein, it is possible to minimize both the dustiness of the compositions described in the Edwards et al patent and the creasing properties of the compositions described in the Temple et al application, while also providing laundered fabrics with anti-wrinkling and ease-of-ironing benefits.

SUMMARY OF THE INVENTION

The instant invention provides detergent compositions which are capable of concurrently cleaning and imparting desirable fabric care and handling properties to fabrics laundered therewith. These compositions comprise:

(a) from about 4% to about 60% by weight of an organic surface-active agent selected from the group consisting of anionic, nonionic, zwitterionic, and ampholytic detergents, and mixtures thereof; and (b) from about 0.1% to about 8% by weight of an intimate comixture of a granular, substantially water-insoluble starch having an average particle diameter of from about 1 to about 45 micrometers and a swelling power of less than about 15 about a temperature of 65° C., and polyethylene glycol having a molecular weight of from about 400 to about 50,000, wherein the ratio of starch to polyethylene glycol component is from about 10:1 to about 1:25.

A method aspect of this invention relates to a method for treating fabrics to simultaneously clean and impart anti-wrinkling and ease-of-ironing benefits, comprising the agitation of those fabrics in an aqueous solution containing from about 0.01% to about 0.3%, preferably from about 0.02% to about 0.2%, by weight, of the detergent compositions described herein.

DETAILED DESCRIPTION OF THE INVENTION

The ingredients, including the starch, anionic surface-active agents, nonionic surface-active agents, ampholytic surface-active agents, zwitterionic surface-active agents, clays, detergency builder salts, and additional laundry additives, which can be present in the compositions of this invention, are fully described in U.S. Pat. No. 3,892,681, Edwards et al, issued July 1, 1975, and U.S. Pat. No. 4,116,854, Temple et al, issued Sept. 26, 1978, both of which are incorporated herein by reference.

The compositions of the present invention contain from about 0.1% to about 8%, preferably from about 0.5% to about 3%, most preferably from about 1% to about 2%, especially about 1.5%, of an intimate comixture of the starch component together with polyethylene glycol having a molecular weight of from about 400 to about 50,000, preferably from about 400 to about 20,000. Polyethylene glycols are polymeric compounds having the formula $HO(CH_2CH_2O)_nH$, where n varies to give the appropriate molecular weight. The starch and polyethylene glycol components are intimately mixed together, in ratios defined herein, and the mixture is generally formed into a particulate additive or is sprayed onto the remainder of the detergent composition. In either case, it is preferred that the polyethylene glycol be in molten form when mixed with the starch. Where the comixture of starch and polyethylene glycol is to be sprayed onto the remainder of the detergent composition, it is preferred that the polyethylene glycol have a molecular weight of from about 400 to about 3,000. Where the method of incorporation utilizes the starch/polyethylene glycol comixture in particulate form, such as admixing of a coflake or prill, it is preferred that the polyethylene glycol have a molecular weight of from about 3,000 to about 20,000, preferably from about 3,600 to about 9,000, especially from about 6,000 to about 7,500. A particularly preferred polyethylene glycol component is PEG 6000, commercially available from Union Carbide Corporation, New York, New York. The starch and polyethylene glycol components are included in the comixture in a ratio of starch to polyethylene glycol of from about 10:1 to about 1:25, preferably from about 3:1 to about 1:5, more preferably from about 2:1 to about 1:2, especially about 2:3.

The preferred starch for use in the compositions of the present invention is corn starch.

The starch/polyethylene glycol comixture may be incorporated into the detergent compositions in ways which are conventionally known and used in the detergency arts. For example, the starch and polyethylene glycol components may be mixed together and either sprayed onto or agglomerated with the remainder of the detergent composition, in granular or particulate form. The polyethylene glycol component may also be sprayed onto the starch, with the resulting product being admixed with the remainder of the detergent composition. In these processes it is preferred that the polyethylene glycol used have a relatively low molecular weight (i.e., from about 400 to about 3,000) in order to give the mixture sufficient fluidity to facilitate the spraying process.

The starch/polyethylene glycol mixture may also be incorporated into the detergent composition by premixing molten polyethylene glycol with the starch and forming either a prill or a coflake from the mixture, using conventionally known techniques, and admixing these prills or coflakes with the remainder of the detergent composition. If the prills or coflakes are admixed with the granules immediately following the spray drying operation, the granules are relatively hot (170°–200° F.), and the prills or coflakes fuse to the granule surfaces. This is desirable, since it decreases segregation of the starch/polyethylene glycol comixture and detergent granules. When the starch/polyethylene glycol comixture is incorporated into the detergent composition in a particulate form, such as a prill or coflake, it is preferred that its particulate size be on the same order of magnitude as the detergent granules with which it is admixed, in order to minimize segregation of the starch-/polyethylene glycol particles from the remainder of the detergent composition. It is preferred that the prills or coflakes formed be of an average size such that they will pass through a No. 10 Tyler Standard Test Sieve, but will remain on a No. 65 Tyler Standard Test Sieve. Further, where the polyethylene glycol and starch components are formed into a coflake, it is preferred that this flake have an average thickness of from about 0.01 to about 0.02 inch in order to improve product solubility and provide a composition which is uniform in appearance.

Contrary to the teachings found in U.S. Pat. No. 3,892,681, it has now been discovered that it is possible to incorporate the starch/polyethylene glycol comixtures, disclosed herein, into a spray-dried detergent granule by incorporating the comixture into the crutcher mix prior to spray-drying. Preferably the conditions of the crutcher are such that only a minimal amount of the starch will be degraded. These conditions, of course, will have to take into account the time the starch is exposed to the crutcher mix, the temperature of the crutcher mix, and the other ingredients of the crutcher mix, among other factors. The combination of all the factors must be adjusted, as is well known in the art, so as to avoid degradation of the starch during the crutching process.

Preferably, the temperature of the crutcher mix should be kept as low as possible, preferably below the gelation temperature of the starch, which is normally in the range of from about 170° F. to 180° F.

In a preferred method of incorporation, the starch-/polyethylene glycol comixture is added to a slurry composed of any silicate that may be used in the composition, optical brighteners, colorants, etc. This slurry can then be added to the crutcher along with the other ingredients. Typically, the crutcher mix is heated to a temperature of from about 150° F. to about 160° F. and then atomized in a spray-drying tower, to form the granule.

All percentages, parts, and ratios used herein are by weight unless otherwise specified.

The following nonlimiting examples illustrate the compositions and the method of the present invention.

EXAMPLE I

Three spray-dried detergent compositions were prepared and their anti-wrinkling performance tested in the following manner. Composition A was prepared by combining and spray-drying the ingredients given below. Composition B, having basically the same formula as that given below except that 0.6% corn starch replaced an equal amount of sodium sulfate, was prepared by combining the ingredients, except for the corn starch, and spray-drying them to form a granule which was then admixed with the dry corn starch. The handling, preparation and admixing of this composition resulted in the presence of corn starch dust in the air. Composition C, having the same formulation as Composition B, was prepared by forming a prill of the corn starch and polyethlene glycol components, and admixing this prill with a spray-dried detergent granule formed with the remaining components.

| Component | Weight % |
|---|---|
| Sodium $C_{13}$ linear alkylbenzene sulfonate | 16.8 |
| Sodium tripolyphosphate | 32.8 |
| Sodium sulfate | 33.5 |
| Sodium silicate solids (2.0r) | 6.0 |
| Polyethylene glycol 6000 | 0.9 |
| Condensation product of coconut alkyl alcohol with 6 moles of ethylene oxide | 0.5 |
| Moisture and minors (including perfume and brightener) | balance to 100 |

Shirt back panels (polyester/cotton fabric) were washed in each of the three compositions and dried in a heated tumble laundry dryer for several cycles. These panels were then round-robin paired and comparison graded by three judges for the last four cycles of the test. Usually there were four replicates of three colors of the shirt panels in each test. Visual preferences were recorded after each of the drying cycles, using a 0 to 4 rating scale where 0 equals no difference between the panels compared, and 4 equals a very large difference. This procedure was repeated twice for each of the detergent compositions and the results were averaged. The panels were washed in a Kenmore top-loading automatic washer set at about 100° F., using 17 gallons of 7 grains hardness water and 77 grams of product.

The results were as follows. Composition A gave panels which had a relative wrinkle appearance with a grade defined as 0; Composition B gave fabrics with a relative wrinkle appearance grade of 0.91; and Composition C, the composition of the present invention, gave fabrics with a relative wrinkle appearance grade of 0.90. Compositions B and C yielded fabrics that were clearly less wrinkled than fabrics which were washed with Composition A. These data indicate that the compositions of the present invention yield an anti-wrinkling advantage when compared to compositions which do not contain the starch component and, at the same time, do not cause the dust and processing disadvantages which accompany the preparation of dry starch compositions, such as Composition B.

Substantially equivalent results are obtained when the anionic surfactants in the above compositions are replaced with an equivalent amount of the condensation product of nonylphenol with about 9.5 moles of ethylene oxide, the condensation product of coconut fatty alcohol with about 6 moles of ethylene oxide, the condensation product of tallow fatty alcohol with about 11 moles of ethylene oxide, the condensation product of a secondary fatty alcohol containing about 15 carbon atoms with about 9 moles of ethylene oxide, 3(N,N-dimethyl-N-alkylammonio) propane-1-sulfonate, wherein the alkyl group averages about 14.8 carbon atoms in length, 3(N,N-dimethyl-N-hexadecylammonio)-propane-1-sulfonate, or mixtures of these surfactants.

Excellent results are obtained where the granular corn starch, used above, is replaced with rice starch, tapioca starch, wheat starch, sweet potato starch, grain sorghum starch, arrowroot granular starch, or mixtures thereof; as well as with comixtures having starch to polyethylene glycol ratios of 5:1, 2:1, 1:1, 1:3, 1:10 or 1:15.

Substantially equivalent results are also obtained where the polyethylene glycol used in the above compositions is replaced by an equivalent amount of polyethylene glycol having a molecular weight of about 1,000, polyethylene glycol having an average molecular weight of about 3,500, polyethylene glycol having a molecular weight of about 7,500, or polyethylene glycol having a molecular weight of about 9,000.

Excellent performance is also obtained when the sodium tripolyphosphate builder used in the compositions above, is replaced with an equivalent amount of sodium nitrilotriacetate, sodium melitate, sodium citrate, sodium carbonate, or mixtures thereof.

EXAMPLE II

A detergent composition having the following formula is prepared by forming coflakes of the polyethylene glycol and corn starch components and admixing these coflakes with spray-dried detergent granules formed with the remaining components, given below.

| Component | Weight % |
|---|---|
| Coflake | |
| Polyethylene glycol having a molecular weight of about 8000 | 0.5 |
| Rice starch | 1.0 |
| Detergent Granule | |
| Sodium tallow alkyl sulfate | 11.0 |
| Sodium dodecylbenzene sulfonate | 9.0 |
| Sodium tripolyphosphate | 47.0 |
| Sodium silicate (1.6r) | 5.0 |
| Sodium sulfate | 11.0 |
| Moisture and minors | balance to 100 |

This composition, when used in the automatic laundering process, at a concentration of about 0.15% in aqueous solution, provides cleaning, anti-wrinkling and ease-of-ironing benefits to the laundered fabrics.

EXAMPLE III

A granular detergent composition, having the formula given below, is prepared by combining the polyethylene glycol and corn starch components, forming this mixture into prills, and admixing these prills with detergent granules formed by spray-drying the remaining components, given below.

| Component | Weight % |
|---|---|
| Prill | |
| Corn starch | 0.6 |
| Polyethylene glycol 6000 | 0.9 |
| Detergent Granule | |
| Sodium dodecylbenzene sulfonate | 12.0 |
| Sodium $C_{14-16}$ alkyl sulfate, ethoxylated with an average of 1.1 moles of ethylene oxide per molecule | 8.0 |
| Sodium tripolyphosphate | 24.4 |
| Sodium sulfate | 33.2 |
| Sodium silicate (2.0r) | 12.0 |
| Coconut fatty alcohol | 0.33 |
| Moisture and minors | balance to 100 |

This composition, when used to launder fabrics, cleans those fabrics while simultaneously providing anti-wrinkling and ease-of-ironing benefits to them.

EXAMPLE IV

The following composition is prepared by mixing the polyethylene glycol and corn starch components, forming them into prills, and admixing these prills with detergent granules, made by combining and spray-drying the remaining components, given below.

| Component | Weight % |
|---|---|
| Prill | |
| Corn starch | 0.6 |
| Polyethylene glycol 6000 | 0.9 |
| Detergent Granule | |
| Sodium dodecylbenzene sulfonate | 12.6 |
| Sodium $C_{14-16}$ alkyl sulfate, ethoxylated with an average of 2.3 moles of ethylene oxide per molecule | 5.4 |
| Zeolite A - $Na_{12}(AlO_2 \cdot SiO_2)_{12} \cdot 27H_2O$ | 25.0 |
| Sodium silicate (1.6r) | 7.0 |
| Sodium carbonate | 13.0 |
| Sodium acetate | 3.0 |
| sodium sulfate | 21.7 |
| Polyethylene glycol 6000 | 0.7 |
| Moisture and minors | balance to 100 |

This composition yields excellent cleaning, wrinkle reduction and ease-of-ironing benefits when used to launder fabrics; and is easy to handle and does not cause a starch dust hazard in its preparation.

EXAMPLE V

A composition, the formula for which is given below, is prepared by making coflakes out of the polyethylene glycol and corn starch components and admixing these coflakes with detergent granules formed by spray-drying the remaining components.

| Component | Weight % |
|---|---|
| Coflake | |
| Corn starch | 0.6 |
| Polyethylene glycol 6000 | 0.9 |
| Detergent granule | |
| Sodium dodecylbenzene sulfonate | 14.0 |
| Sodium $C_{14-16}$ alkyl sulfate, ethoxylated with an average of 2.3 moles of ethylene oxide per molecule | 6.0 |
| Sodium sulfate | 30.8 |
| Sodium silicate (2.4r) | 20.0 |
| Sodium carbonate | 20.0 |
| Polyethylene glycol 6000 | 0.7 |
| Moisture and minors | balance to 100 |

This composition yields anti-wrinkle and ease-of-ironing benefits which are superior to those obtained using the same composition without the corn starch additive, and provides processing advantages, in terms of dust control, over a detergent composition having the same formulation but where the dry starch is admixed with the detergent granules.

What is claimed is:

1. A laundry detergent composition comprising:

(a) from about 4% to about 60% by weight of an organic surface-active agent selected from the group consisting of anionic, nonionic, zwitterionic, and ampholytic detergents, and mixtures thereof; and (b) from about 0.1% to about 8% by weight of an intimate comixture of granular, substantially water-insoluble starch having an average particle diameter of from about 1 to about 45 micrometers and a swelling power of less than about 15 at a temperature of 65° C., and polyethylene glycol having a molecular weight of from about 400 to about 50,000, wherein the ratio by weight of starch to polyethylene glycol is from about 10:1 to about 1:25.

2. A composition according to claim 1 wherein the polyethylene glycol has a molecular weight of from about 400 to about 3,000.

3. A composition according to claim 2 wherein said comixture of starch and polyethylene glycol is sprayed onto the remainder of the detergent composition in granular form.

4. A composition according to claim 1 wherein the polyethylene glycol has a molecular weight of from about 3,000 to about 20,000.

5. A composition according to claim 4 which contains from about 0.5% to about 3% by weight of the comixture of starch and polyethylene glycol.

6. A composition according to claim 5 wherein the ratio of starch to polyethylene glycol is from about 3:1 to about 1:5.

7. A composition according to claim 4 wherein the polyethylene glycol has a molecular weight of from about 3,600 to about 9,000.

8. A composition according to claim 7 which contains from about 0.5% to about 3% by weight of the comixture of starch and polyethylene glycol.

9. A composition according to claim 8 wherein the ratio of starch to polyethylene glycol is from about 3:1 to about 1:5.

10. A composition according to claim 9 wherein the ratio of starch to polyethylene glycol is from about 2:1 to about 1:2.

11. A composition according to claim 1 in which the granular starch is corn starch.

12. A composition according to claim 11 wherein the polyethylene glycol has a molecular weight of from about 3,600 to about 9,000.

13. A composition according to claim 12 wherein the ratio of starch to polyethylene glycol is from about 2:1 to about 1:2.

14. A composition according to claim 13 wherein the polyethylene glycol has a molecular weight of from about 6,000 to about 7,500.

15. A composition according to claim 14 which contains from about 1% to about 2% by weight of the comixture of starch and polyethylene glycol.

16. A composition according to claim 4 wherein the starch and polyethylene glycol components are formed into a coflake which is admixed with the remainder of the detergent composition.

17. A composition according to claim 4 wherein the starch and polyethylene glycol components are formed into a prill which is admixed with the remainder of the detergent composition.

18. A method for treating fabrics to simultaneously clean and impart anti-wrinkling, ease of ironing, softening and static control properties, said method comprising the agitation of the fabrics in an aqueous solution containing from about 0.01% to about 0.3% of the detergent composition of claim 1.

* * * * *